United States Patent [19]

Gualillo et al.

[11] 4,140,562

[45] Feb. 20, 1979

[54] SOLID PROPELLANT WITH ALGINATE BINDER

[75] Inventors: Silvio P. Gualillo, Baltimore; Regis Raab, Towson; Edward G. Uhl, Ruxton, all of Md.

[73] Assignee: Martin Marietta Corporation, Bethesda, Md.

[21] Appl. No.: 291,786

[22] Filed: Jun. 4, 1952

[51] Int. Cl.[2] ..... C06B 45/10

[52] U.S. Cl. ..... 149/19.1; 149/20; 149/18; 149/19.92

[58] Field of Search ..... 52/14, 15, 0.5; 44/15, 44/17; 252/1.1; 149/18, 19.1, 19.92, 20

[56] References Cited

FOREIGN PATENT DOCUMENTS

| | | | |
|---|---|---|---|
| 903737 | 1/1945 | France | 44/15 |
| 477 of | 1865 | United Kingdom | 44/7 |
| 1773 of | 1901 | United Kingdom | 44/15 |
| 211174 | 2/1924 | United Kingdom | 44/15 |
| 570075 | 7/1945 | United Kingdom | 52/14 |
| 655585 | 7/1951 | United Kingdom | 52/0.5 |

*Primary Examiner*—Edward A. Miller

*Attorney, Agent, or Firm*—Gay Chin; James B. Eisel

EXEMPLARY CLAIM

1. A solid propellant fuel composition for rockets comprising ammonium nitrate and a water-soluble compound of alginic acid selected from the group consisting of sodium alginate, potassium alginate, ammonium alginate, triethanolamine alginate and propylene glycol ester of alginic acid as the principal essential ingredients, the alginic acid component being employed in the ratio of about 2.5 to 5.5 parts per 12 parts of ammonium nitrate.

21 Claims, No Drawings

SOLID PROPELLANT WITH ALGINATE BINDER

This invention relates to a new and improved solid propellant fuel for rockets, and to a new and improved process for compounding such fuels.

One of the principal objects of the present invention is to provide an improved solid propellant fuel for use in solid propellant fuel rockets, and which when burned produces gases at very high temperature and pressures. Another object of the invention is to provide a new and improved process for preparing such fuels.

The manner in which these and other objects and features of the invention are attained will appear more fully from the following description thereof, in which reference is made to typical and preferred procedures by way of example, but without intending to limit the invention thereby.

It is of course well known that rockets may be propelled by the combustion of a suitable fuel which, when burned, acts to produce gases at high temperatures and pressures. These gases when expanded through the rocket nozzle provide the necessary thrust to propel the rocket. It is necessary that such a rocket fuel shall have a very rapid rate of burning in order to produce a sufficiently large volume of gases per unit time such that their expansion through the rocket nozzle will produce the required thrust.

According to the present invention it has been discovered that a solid propellant fuel for rockets that is of outstanding characteristics may be made from a composition comprising ammonium nitrate and a water-soluble derivative of alginic acid as the principal active ingredients. Among suitable water-soluble derivatives of alginic acid are water-soluble inorganic salts such as the sodium, potassium and ammonium alginates, organic salts such as the alkanolamine salts (e.g., the triethanolamine salt) and esters such as the propylene glycol ester of alginic acid. However, because of its relative cheapness and availability, it is ordinarily preferred to employ the sodium alginate salt.

As another feature of the invention it has been discovered that the solid rocket fuel composition may be compounded in such manner as to eliminate the necessity for intensively milling the ammonium nitrate, and perhaps other sensitive ingredients of the composition that will be mentioned hereinafter. Thus, it has been discovered that the solid rocket fuel composition of the present invention may be made by a process which, generally speaking, involves making up a very highly concentrated solution of ammonium nitrate in water at elevated temperatures such as of the order of 135°–140° C., to which the powdered alginate derivative, such as sodium alginate, is added with stirring. The mixture is stirred at this temperature until a uniform doughlike mass results, with or without the addition of still further ingredients to be mentioned hereinafter, after which the composition may be molded at suitable pressures, such as from 2000–5000 p.s.i. to the desired shape or grain size. The water initially present and/or remaining in the composition is thereafter removed by drying the thus-molded grains in a suitable drying oven.

Since both principal components of the rocket propellant fuel composition are water soluble, the process of the present invention makes it possible to produce a very intimate mixture of the components cheaply and with relative safety, and hence is of outstanding importance.

The finished grains of propellant fuel are brown to dark brown in color, hard and somewhat brittle. They burn very rapidly. They are used in the same manner as other propellants in rockets, preferably being ignited by one of the usual types of explosive igniters such as black powder or the like. The calorific value of the composition is desirably high.

While a very satisfactory solid propellant fuel for rockets may be made from the ingredients mentioned above, it may under certain circumstances be found desirable to include in the composition portions of other ingredients such as ammonium dichromate to act as a burning catalyst, graphite to assist in bringing about an even burning of the grains, flaked or powdered metals such as aluminum and magnesium that burn in a highly exothermic manner, as well as dextrine or starch or other like readily oxidizable substances. All of the foregoing substances are useful combustion-promoting additives for the solid rocket fuel composition of the present invention.

In order further to illustrate the invention, but without limiting the scope thereof, the following specific example showing a typical and preferred procedure as applied to a typical and preferred composition is hereinafter set forth, the parts being by weight:

EXAMPLE

| | |
|---|---|
| Ammonium nitrate | 12 parts |
| Alginate derivative, such as sodium alginate | 2.5 to 5.5 parts, preferably about 3.5 parts |
| Water | 0.75 to 1.5 parts, preferably about 1 part |
| Ammonium dichromate | 0.2 to 1 part, preferably about 0.6 part |
| Graphite | 0.06 part to 0.48 part, preferably about 0.24 part |

The water and the ammonium nitrate are combined and heated in any suitable manner, such as in an oil bath, to about 135° C. The ammonium dichromate and sodium alginate are then added and mixed intimately into the composition while holding the entire mass at about 135° C. The finely divided graphite is then thoroughly incorporated into the resulting dough-like composition. If desired, this latter step may be performed after the mixture has been permitted to cool somewhat. The composition is then molded in a conventional molding device at a pressure of from 2000 to 5000 p.s.i., the mold being heated to about 65° C., after which the molded grains are placed in a drying oven for removal of residual water. The dried grains are then ready for use of a solid rocket propellant fuel. However, since the grains are quite moisture absorbent, unless they are to be used relatively soon after they have been dried they should be provided with a suitable moisture-proof covering, such as paraffin, paraffin-petrolatum mixtures, etc.

It will be particularly observed that the amount of water employed in making up the composition is relatively small, ordinarily, considerably less than 10% by weight of the composition. This in fact constitutes an important feature of the invention since, when the ammonium nitrate is added to the water, a very concentrated solution results. When the sodium alginate is then added, it completely absorbs the solution to produce a dough-like mass of relatively low water content with the ammonium nitrate uniformly and thoroughly dispersed therethrough in intimate relationship to the other ingredients. This doughy mass is of a consistency such that it may be readily molded into the desired grains, while the required drying time necessary to remove the water from the molded grains is kept to a minimum. Moreover, no extensive grinding operation with the attendant danger of premature explosion is necessary.

The size and shape of the molded grains will, of course, depend upon the particular use for which they are intended. In accordance with standard practice, they will ordinarily be generally cylindrical in shape and several inches in length, and will be proportioned so as to provide a relatively high ratio of exposed burning surface to the area of the nozzle opening of the rocket motor with which they are to be used. The fuel grains can be drilled, cut, chipped, and otherwise mechanically worked, thereby making it convenient to shape them to any configuration found desirable for any given purpose.

The burning time may be varied within certain limits as by varying the ratio of the alginate component to the ammonium nitrate component from approximately 10% to approximately 50% excess of the alginate component, i.e., in the case of sodium alginate by increasing the alginate component from about 3.5 parts to about 5.5 parts per 12 parts of ammonium nitrate.

While a specific example illustrating the present invention has been set forth above, it will be apparent that many changes and modifications may be made therein without departing from the spirit of the invention. It is therefore to be understood that the example cited and the particular proportions and details set forth above are intended to be illustrative only and are not intended to limit the scope of the invention.

What is claimed is:

1. A solid propellant fuel composition for rockets comprising ammonium nitrate and a water-soluble compound of alginic acid selected from the group consisting of sodium alginate, potassium alginate, ammonium alginate, triethanolamine alginate and propylene glycol ester of alginic acid as the principal essential ingredients, the alginic acid component being employed in the ratio of about 2.5 to 5.5 parts per 12 parts of ammonium nitrate.

2. A solid propellant fuel composition for rockets comprising ammonium nitrate and a water-soluble salt of alginic acid as the principal essential ingredients, the alginic acid component being employed in the ratio of about 2.5 to 5.5 parts per 12 parts of ammonium nitrate.

3. A solid propellant fuel composition for rockets comprising ammonium nitrate and sodium alginate as the principal essential ingredients, the sodium alginate being employed in the ratio of about 2.5 to 5.5 parts per 12 parts of ammonium nitrate.

4. A composition as in claim 1 containing a minor proportion of at least one additional readily oxidizable ingredient selected from the class consisting of dextrine and starch.

5. A composition as in claim 2 containing a minor proportion of at least one additional readily oxidizable ingredient selected from the class consisting of dextrine and starch.

6. A composition as in claim 3 containing a minor proportion of at least one additional readily oxidizable ingredient selected from the class consisting of dextrine and starch.

7. A method of making a solid propellant fuel composition for rockets in which the principal active ingredients are ammonium nitrate and a water-soluble compound of alginic acid selected from the group consisting of sodium alginate, potassium alginate, ammonium alginate, triethanolamine alginate and propylene glycol ester of alginic acid comprising heating ammonium nitrate in admixture with a relatively small quantity of water in order to produce a highly concentrated solution of ammonium nitrate, adding the water-soluble derivative of alginic acid thereto and mixing it with the ammonium nitrate to produce a doughy mass of relatively low water content while the composition is at an elevated temperature, and thereafter forming the composition into solid fuel grains.

8. A method as in claim 7 in which at least one additional readily oxidizable ingredient selected from the class consisting of dextrine, and starch is added to the fuel composition prior to the forming step.

9. A method as in claim 7 in which the solid fuel grains are formed by molding the composition in a heated mold under high pressure.

10. A composition as in claim 1 containing a minor proportion of at least one additional combustion-promoting ingredient selected from the class consisting of aluminum and magnesium.

11. A composition as in claim 2 containing a minor proportion of at least one additional highly exothermic ingredient selected from the class consisting of aluminum and magnesium.

12. A composition as in claim 3 containing a minor proportion of at least one additional highly exothermic ingredient selected from the class consisting of aluminum and magnesium.

13. A method as in claim 7 in which at least one additional highly exothermic ingredient selected from the class consisting of aluminum and magnesium is added to the fuel composition prior to the forming step.

14. A composition as in claim 1 containing a minor proportion of graphite.

15. A composition as in claim 2 containing a minor proportion of graphite.

16. A composition as in claim 3 containing a minor proportion of graphite.

17. A method as in claim 7 in which graphite is added to the fuel composition prior to the forming step.

18. A composition as in claim 1 containing a minor proportion of ammonium dichromate.

19. A composition as in claim 2 containing a minor proportion of ammonium dichromate.

20. A composition as in claim 3 containing a minor proportion of ammonium dichromate.

21. A method as in claim 7 in which ammonium dichromate is added to the fuel composition prior to the forming step.

* * * * *